US005452214A

United States Patent [19]

Gallagher

[11] Patent Number: 5,452,214

[45] Date of Patent: Sep. 19, 1995

[54] METHOD FOR INITIALIZING A TAPE FEEDING, CUTTING AND EJECTION APPARATUS FOR A MAILING MACHINE

[75] Inventor: Dennis M. Gallagher, Danbury, Conn.

[73] Assignee: Pitney Bowes Inc., Stamford, Conn.

[21] Appl. No.: 203,454

[22] Filed: Feb. 28, 1994

[51] Int. Cl.[6] ..... G07B 17/00

[52] U.S. Cl. ..... 364/464.02

[58] Field of Search ..... 364/464.02

[56] References Cited

U.S. PATENT DOCUMENTS 4,611,736 9/1986 Gavronsky et al. .

4,628,476 12/1986 Duwel ..... 364/464.02

4,665,353 5/1987 Salazar et al. .

4,817,004 3/1989 Kroll et al. ..... 364/464.02

4,922,085 5/1990 Dannat et al. .

5,212,531 5/1993 Monma et al. .

5,310,128 5/1994 Doeberl et al. ..... 242/591

*Primary Examiner*—Edward R. Cosimano

*Attorney, Agent, or Firm*—Steven J. Shapiro; David E. Pitchenik; Melvin J. Scolnick

[57] ABSTRACT

A mailing machine which incorporates the method in includes a postage meter having a postage meter drum. There is a sensor for detecting tape in the tape path and a knife for cutting the tape and means for ejecting a cut segment of tape. The method for initializing the machine includes the steps of testing for each of the conditions which may indicate that there was a failure to complete a proper sequence of ejection of a cut tape prior to the machine shutting down. A plurality of recovery sequences of steps are provided to eject the cut tape and place the end of the tape roll into a known position.

6 Claims, 6 Drawing Sheets

METHOD FOR INITIALIZING A TAPE FEEDING, CUTTING AND EJECTION APPARATUS FOR A MAILING MACHINE

FIELD OF THE INVENTION

The invention relates to mailing machines and more particularly tape dispensing units associated with the mailing machines.

BACKGROUND OF THE INVENTION

This application is related to the following five applications concurrently filed directed to a tape feeding, cutting and ejecting apparatus for a mailing machine: Ser. No. 203,132 for Roll-Tape Knife Control for a Tape-Cutting Apparatus in a Mailing Machine; Ser. No. 203,130 for Method for Preventing Jams in a Tape Ejecting Apparatus; Set. No. 203,454; Ser. No. 203,459 for Method for Controlling Speed in a Tape Feeding, Cutting and Ejection Apparatus for a Mailing Machine; Ser. No. 203,461 for Method for Control of Length of Imprint for a Mailing Machine; and, Ser. No. 203,460 now U.S. Pat. No. 5,415,484 for Method and Apparatus for Cutting Mailing Machine Roll Tape, all assigned to the assignee of the present invention.

In addition it is related to the following applications Ser. No. 180,161 now U.S. Pat. No. 5,392,703 and Ser. No. 180,168 now U.S. Pat. No. 5,390,594 for Tape Feeding, Cutting and Ejecting Apparatus for a Mailing Machine filed Jan. 11, 1994 and Ser. No. 180,163 now U.S. Pat. No. 5,392,704 for Mailing Machine also filed January 11, 1994, all assigned to the assignee of the present invention.

Mailing machines are well known. Generally, mailing machines comprise a postage meter for printing an indicia on a piece of mail or on a tape and a feed base for transporting mailpieces or tapes for printing by the postage meter. Tape feeding mechanisms have typically not been incorporated into small mailing machines because of the costs involved.

Applications Ser. No. 180,161 now U.S. Pat. No. 5,392,703 and Ser. No. 180,168 now U.S. Pat. No. 5,390,594 for Tape Feeding, Cutting and Ejecting Apparatus for a Mailing Machine filed Jan. 11, 1994 and Ser. No. 180,163 now U.S. Pat. No. 5,392,704 for Mailing Machine also filed Jan. 11, 1994, previously mentioned above, describe a mailing machine in which a roll tape supply is utilized for printing postage. The various paths of tape supply for feeding tape for printing and for ejecting the cut tape are for the most part inaccessible to the operator.

It has been recognized that the mailing machine may be shut down in any stage of operation. Since most of the feeding operations are controlled in essentially open loop control modes in order to reduce cost and since the tape paths are almost inaccessible to the user, the clearing of tape jams would require a service call.

SUMMARY OF THE INVENTION

It is therefore an object of the invention to initialize the mailing machine in such a manner as to prevent tape jams which may occur because of conditions which were created at the shutdown of the mailing machine.

These and other objects are attained in a novel method for initializing a mailing machine which includes a postage meter having a postage meter drum, a sensor for detecting a tape in a path and a knife for cutting the tape and means for ejecting a cut segment of tape, the method comprising the steps of providing tests for each of a plurality of conditions indicative of a failure to complete a proper sequence of ejection of a cut tape, providing a plurality of sequences of steps for placing an end of a tape roll into a known initial position from each of the respective determined failure conditions, testing for each of the plurality of conditions indicative of a failure to complete a proper sequence of ejection of a cut tape from the mailing machine, and in response to a detection of a failure condition selecting a determined one of the plurality of sequences in order to initialize the tape roll to a known starting point and to eject a cut tape whereby tape jams on succeeding operations are prevented.

DESCRIPTION OF THE PREFERRED EMBODIMENT

Figure 1:
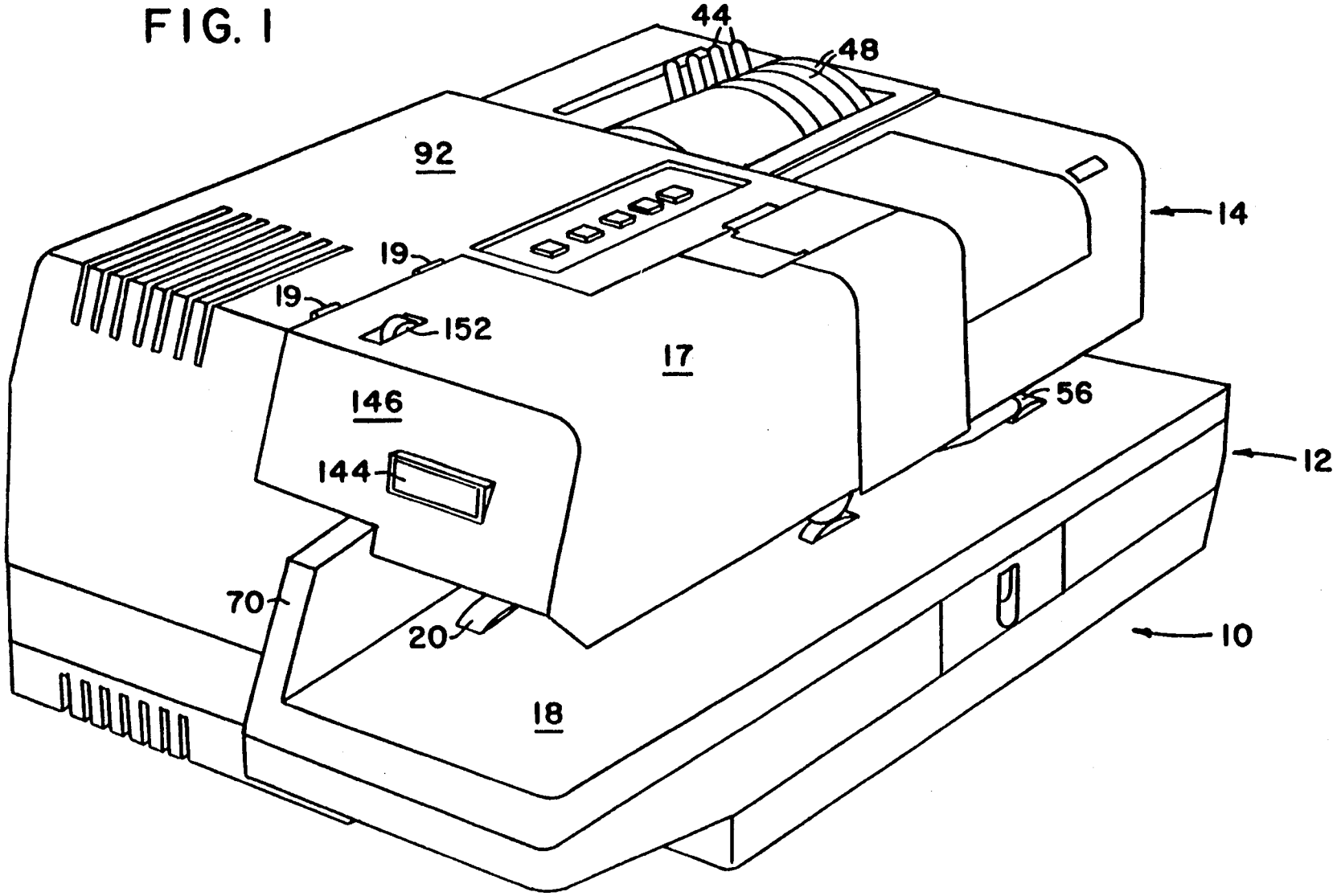
FIG. 1 is a general perspective view of a mailing machine embodying the present invention.
Figure 2:
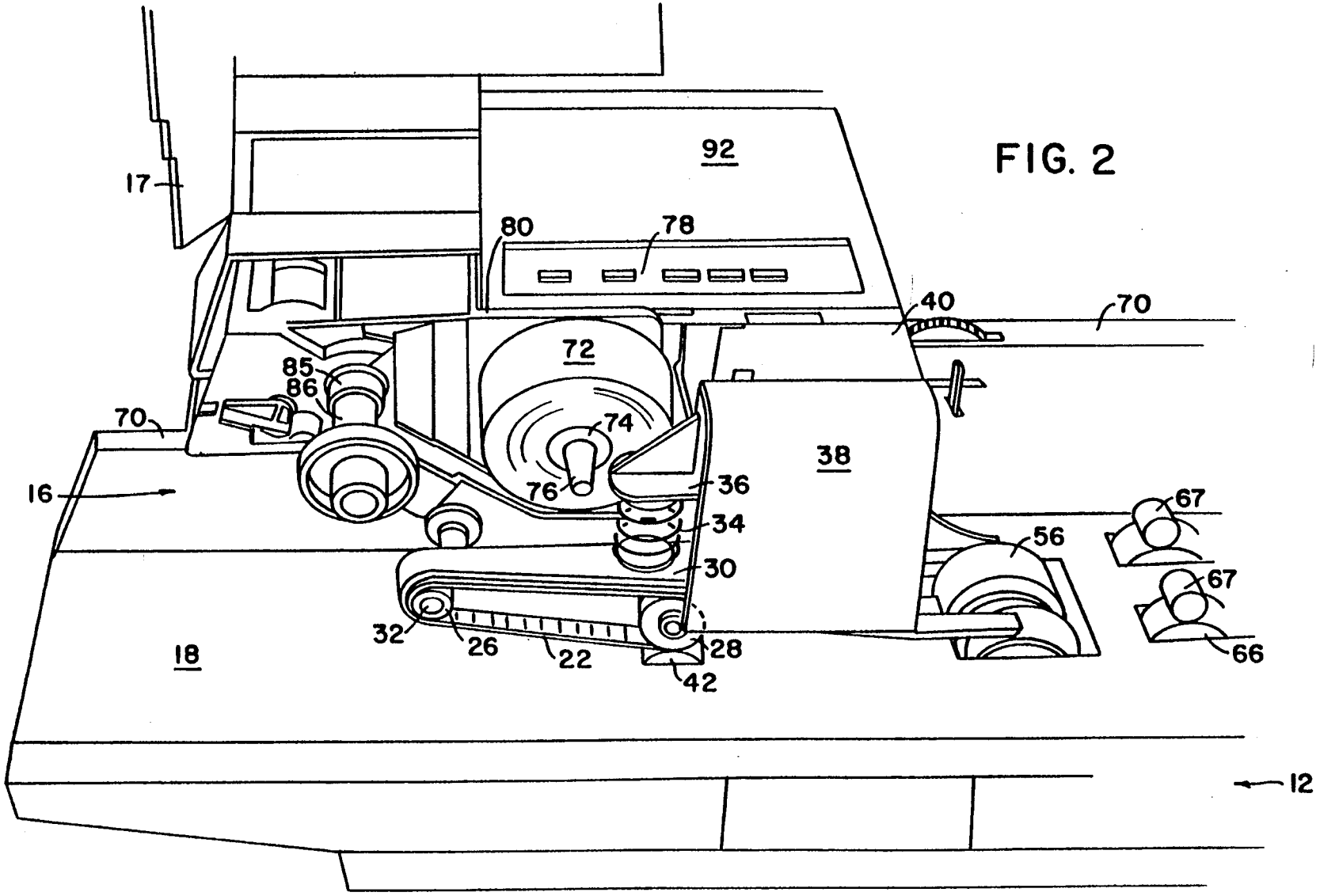
FIG. 2 is a frontal perspective view of the mailing machine shown in FIG. 1 with some covers removed to expose details.

In FIGS. 1 and 2, there is shown generally at 10 a mailing machine as described generally in applications Ser. No. 180,163 now U.S. Pat. No. 5,342,704 for Mailing Machine, Ser. No. 180,161 now U.S. Pat. No. 5,392,703 and Ser. No. 180,168 now U.S. Pat. No. 5,390,594 for Tape Feeding, Cutting and Ejecting Apparatus for a Mailing Machine all filed Jan. 11, 1994, each assigned to the assignee of the present invention and specifically incorporated herein by reference.

The mailing machine includes a base shown generally at 12, a postage meter generally designated at 14, and a tape feeding, cutting, and ejection apparatus shown generally at 16 (FIG. 2). The mailing machine preferably includes a housing having a pivoted cover 17 connected by hinges 19 which can be raised to provide access.

The base 12 comprises a feed deck 18 which extends through the mailing machine 10 for support of mailpieces. Feeding rollers 20 project upward through the deck for engaging the underside of the mailpieces while belt 22 which extends around drive pulley 26 and idler pulley 28 serves to engage the upper surface for transporting the mailpiece for feeding to the postage meter. The outer surface of belt 22 passing around idler pulley 28 is mounted on elongate housing 30 which is pivoted about shaft 32 which drives the pulley 26. Housing 30 is spring loaded downwardly by spring 34 on bracket 36 formed on ink cartridge housing 38 which holds a removable ink cartridge 40. Belt 22 engages an idler roller 42 mounted beneath the feed deck 18 which acts as a pressure backup to ensure proper feeding of mailpieces between the belt 22 and idler roller 42.

Figure 3:
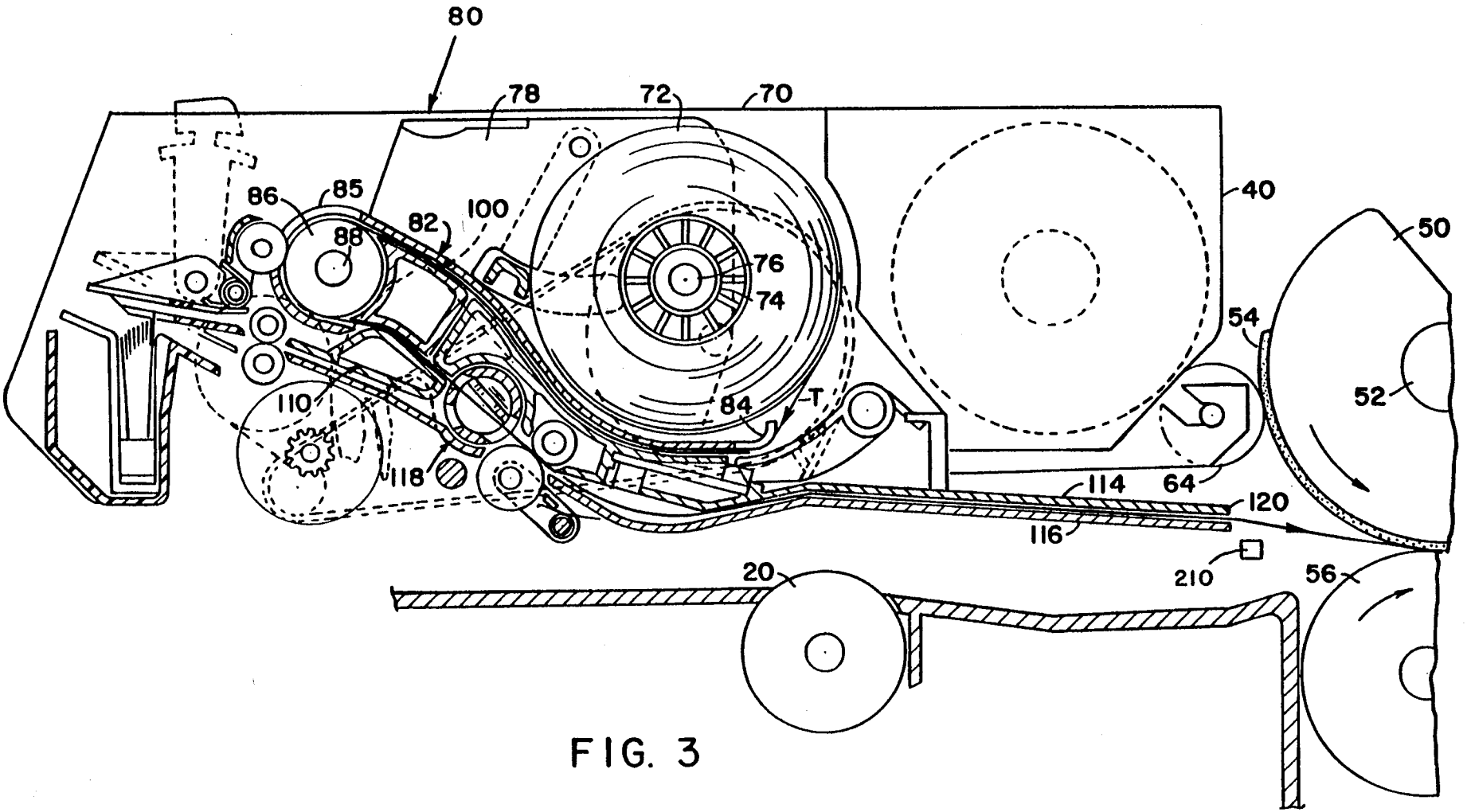
FIG. 3 is a view of the tape feeding, cutting and ejecting apparatus shown in place in the mailing machine.

Postage meter 14 has a plurality of setting levers 44 for setting postage in accordance with numerals on scales 48. As seen in FIG. 3 the postage meter includes print drum 50 mounted on shaft 52 which is driven for rotation of the drum. Drum 50 carries a printing die 54 for printing the indicia on a mailpiece pressed into firm engagement by impression rollers 56. The ink cartridge 40 contacts spring loaded transfer roller 64 for transferring ink to the printing die 54 on each revolution of the printing drum.

Returning to FIG. 2, the base further includes a plurality of eject rollers 66 and cooperating spring loaded pressure rollers 67 for conveying the mailpiece to the end of the feed deck.

Figure 4:
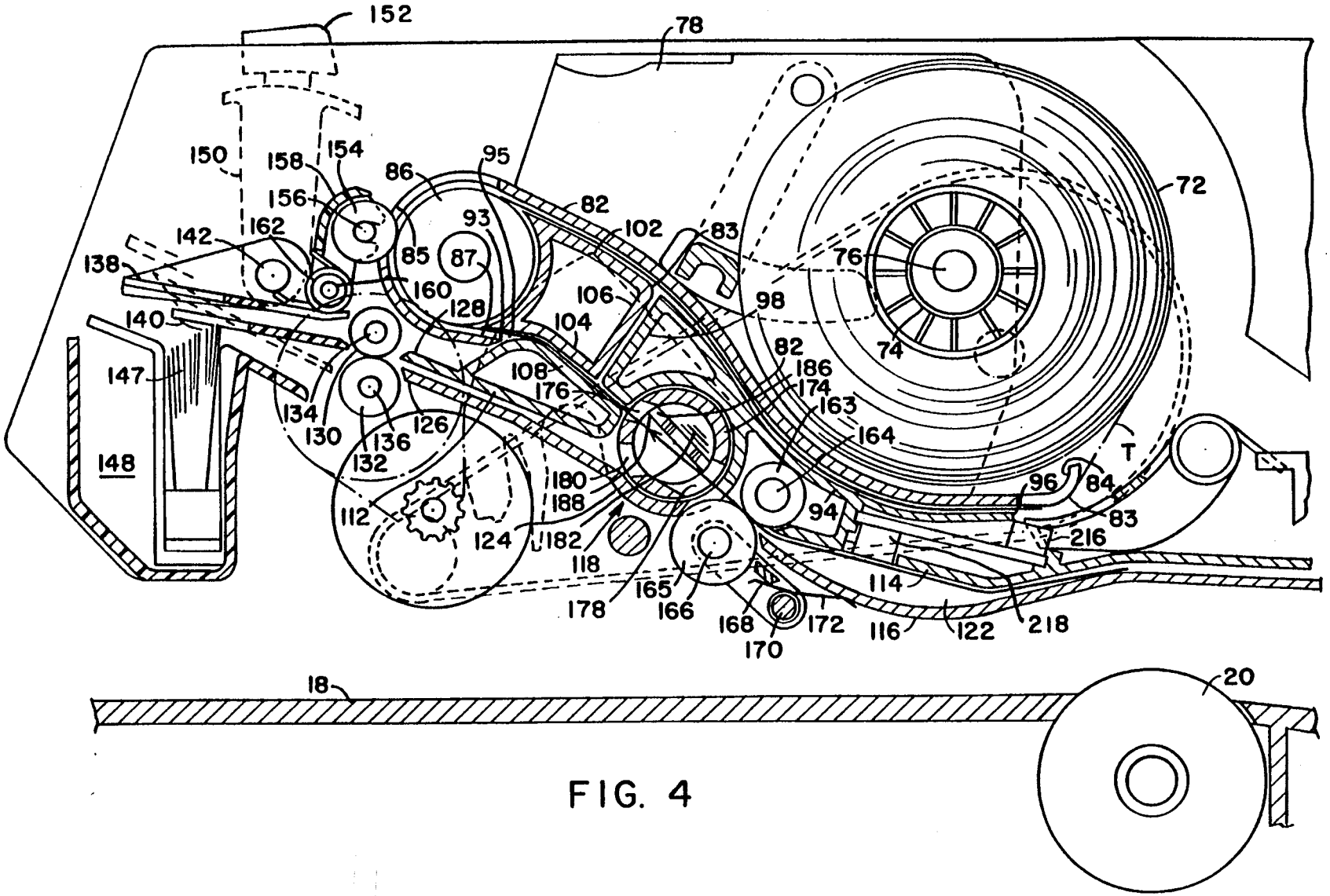
FIG. 4 is a view similar to FIG. 3 but drawn to enlarged scale and partly in longitudinal section to reveal particular details.

Referring now to FIGS. 3 and 4, the base 12 includes a wall 70 (also in FIGS. 1 and 2). The tape feeding, cutting and ejection apparatus 16 is mounted on the wall 70. Apparatus 16 includes a roll of tape 72 suitably mounted on spindle 74 which in turn is mounted on tape holding means which includes stub shaft 76 fixed to an upstanding wall 78 of a movable mounting frame designated generally at 80.

The mounting frame 80 also includes an upper guide plate 82 and has an upturned lip 84 which forms an entrance guide for the strip of tape "T" as it comes off the roll. The upper guide plate terminates in a pair of spaced apart U-shaped portions 85 which fit closely around the outer periphery of a drum shaped tape feed roller 86 fixedly mounted on shaft 88.

As best seen in FIG. 4, the strip is threaded through slot 83 formed formed by the lower surface of the upper guide plate 82 and guide wall 102. The U-shaped portions terminate in a flat portion 87 which is tapered to form a cutting edge 93 against which the free end of tape T is pulled , after it exits through slot 95 defined by edge 93 and guide wall 104. The lower guide plate 94 is disposed contiguously with guide plate 82 over most of its length commencing at end 96 and extending to wall 98.

An upper intermediate guide portion indicated at 100 is arranged in the space between wall 98 and tape feed roller 86 and includes the guide walls 102 and 104 and an upright wall 106 between the walls 102 and 104. The lower guide wall 104 is disposed in close relationship with an upper guide wall 108 of a lower intermediate guide portion designated by 110. This intermediate portion 110 has a lower guide wall 112.

A second set of guide plates 114 and 116 extend generally from a point adjacent a severing mechanism 118 to another point 120 adjacent the nip of the printing drum 50 and the impression roller 56. There is a short span where these guide plates are separated by a substantially larger distance to form a gap 122. The foregoing plates all define a first feed path for the tape.

Another elongate guide plate 124 extends rearwardly from beneath the severing mechanism 118 to an opposite end 126 The lower guide wall 112 of the intermediate guide portion 110 also has an end 128 located adjacent to the end 126 of the guide plate 124. A pair of feed rollers 130 and 132 are mounted on shafts 134 and 136 respectively.

On the opposite side of the feed rollers 130 and 132 is a tape deflector having closely spaced apart upper and lower guide plates 138 and 140 which are suitably connected together to form an integral unit which is fixedly mounted on on shaft 142. The deflector plates 138 and 140 lead to an outlet opening 144 (FIG. 1) formed in the side wall 146 of the cover. Lever 150 is suitably connected to shaft 142 and terminates upwardly in in a finger button 152 which projects through a top wall 92 to allow the operator to oscillate the shaft 142 back and forth to move the deflector plates 138 and 140 between the solid lines and dotted line position seen in FIG. 4. It will be noted that with the plates in the solid line position, a cut piece of tape is directed under the deflector plate 140 and over the top of the bristles 147 of moistening device 148. If in the dotted position, the deflector plates prevent the tape from being moistened and it is sent directly to the opening 144.

The tape feeding means comprises tape feed roller 86 and idler roller 154 which is rotatably mounted on shaft 156 fixed in frame 158, which in turn is pivotally mounted on shaft 160. Coil spring 162 is wrapped around the shaft 160 so that the ends bear against the frame 158 and the upper surface of deflector plate 138 to urge the frame 158 toward the feed roller 86, and thereby pressing the idler roller 54 into firm engagement with the tape as it passes around the feed roller 86.

Another feed roller 163 is fixedly mounted on a shaft 164 which is rotatably mounted in the frame. A pair of backup idler rollers 165 are mounted on shaft 166 which is rotatably mounted in frame 168 which in turn is pivotally mounted on another shaft 170 which is mounted on the frame walls. Coil spring 172 is mounted on the shaft 170 to urge the idler roller 165 toward the feed roller 163 to provide firm driving engagement between the feed roller 163 and the tape.

It will be appreciated that the feed roller 86 and backup idler roller 158, the feed roller 163 and backup idler roller 165 are all in the first path and serve both to feed the tape and to bring it back to the point where the tape is severed. The set of feed rollers 130 and 132 are disposed in a second path for ejecting the severed piece of tape.

The severing mechanism 118 comprises a cylindrical tubular member 174. This member has a plurality of axially elongate slots through which the tape passes, both in forward and reverse movements. Slot 176 provides an entrance for the tape and a second slot 178 provides an exit. A third slot 180 is formed on the same side as slot 176 to provide an exit for the severed portion of the tape and to direct the tape into the second feed path for ejection of the tape.

A movable cutting member or knife 182 is rotatably mounted in the tubular member 174, the cutting member having a close tolerance fit within the member 174. The knife 182 has a flat surface 186 which is angled slightly and defining a sharpened edge 188 which functions as a moveable blade for cutting the tape when the cutting member 182 is rotated. When the blade moves, it not only severs the tape but depresses the leading edge of the cut piece of tape to the lower slot 180 to direct the cut piece into the second path.

The drive mechanism is implemented suitably with a DC reversing motor (not seen in these figures) as described in connection with applications Ser. No. 180,163 now U.S. Pat. No. 5,392,704 for Mailing Machine, Ser. No. 180,161 now U.S. Pat. No. 5,392,703 and Ser. No. 180,168 now U.S. Pat. No. 5,390,594 for Tape Feeding, Cutting and Ejecting Apparatus for a Mailing Machine, previously incorporated by reference herein. The result of the operation is that a tape is fed to the postage meter for imprinting along a first path and then the tape is reversed and the appropriate strip length is severed and the severed tape strip is ejected along the second path. The complete operation is described in these referenced applications and will not be further described herein except as required for the discussion of the present invention.

Figure 5:
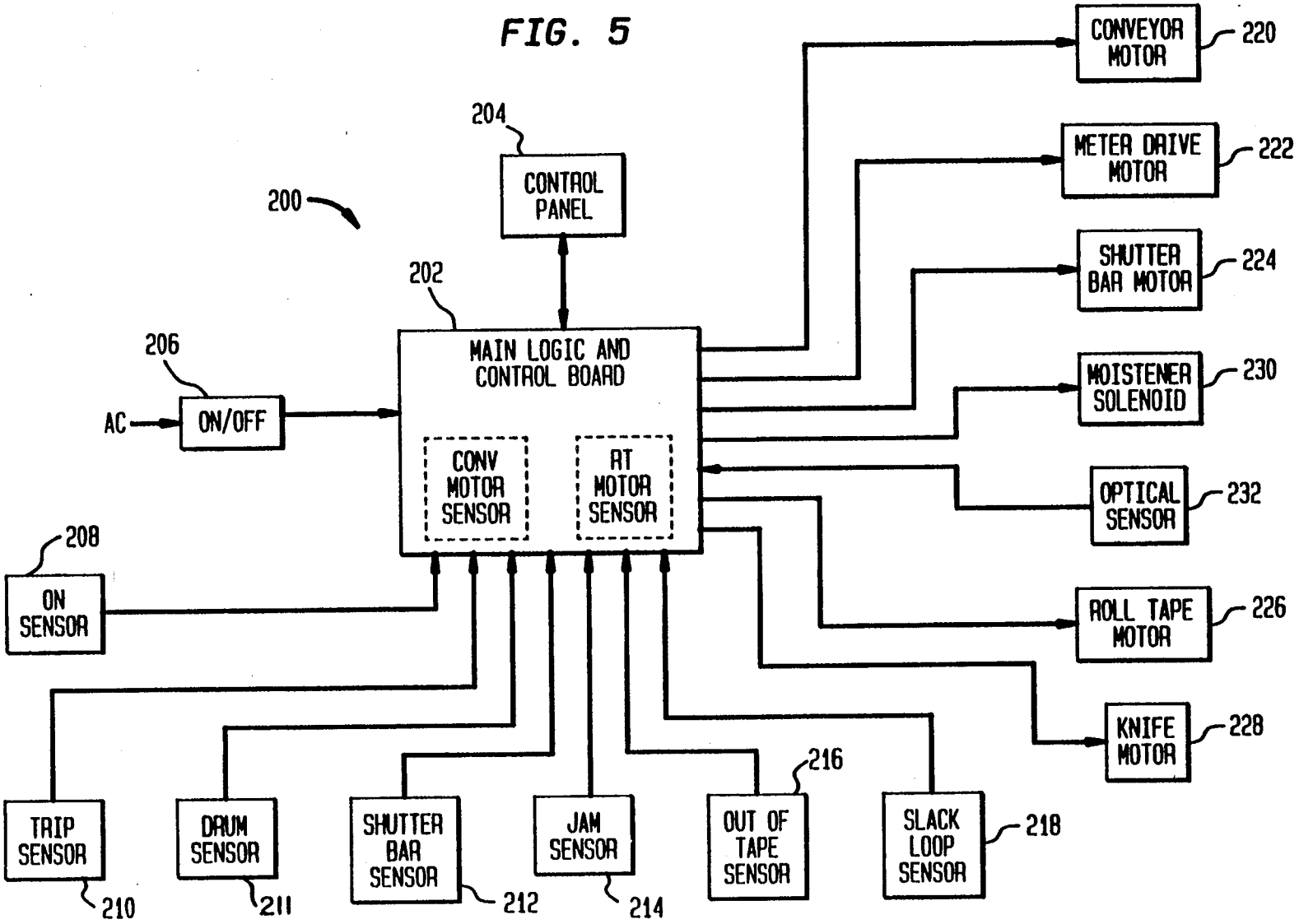
FIG. 5 is a schematic block diagram of the electronic components of the mailing machine.

FIG. 5 is a circuit block diagram of the mailing machine. As seen generally at 200, the main logic and control board 202 receives information from a control panel 204 when A/C power has been applied via on/off switch 206. Various sensors, such as those illustrated for determining the ON condition, 208; trip sensor, 210; drum sensor, 211; shutter bar sensor, 212; jam sensor, 214; out-of-tape sensor, 216; and slack loop sensor, 218 provide information to the control board 202 about the state of the machine while the board outputs information for driving the various motors and solenoids. These motors are the conveyor motor, 220; the meter drive motor, 222; the shutter bar motor, 224; the roll tape drive motor, 226; and the knife motor, 228. The board also provides control information to the moistener solenoid 230 and receives optical count data indicated here at block 232 from an optical sensor and slotted rotating disc operatively connected to the roll tape motor.

Figure 6:
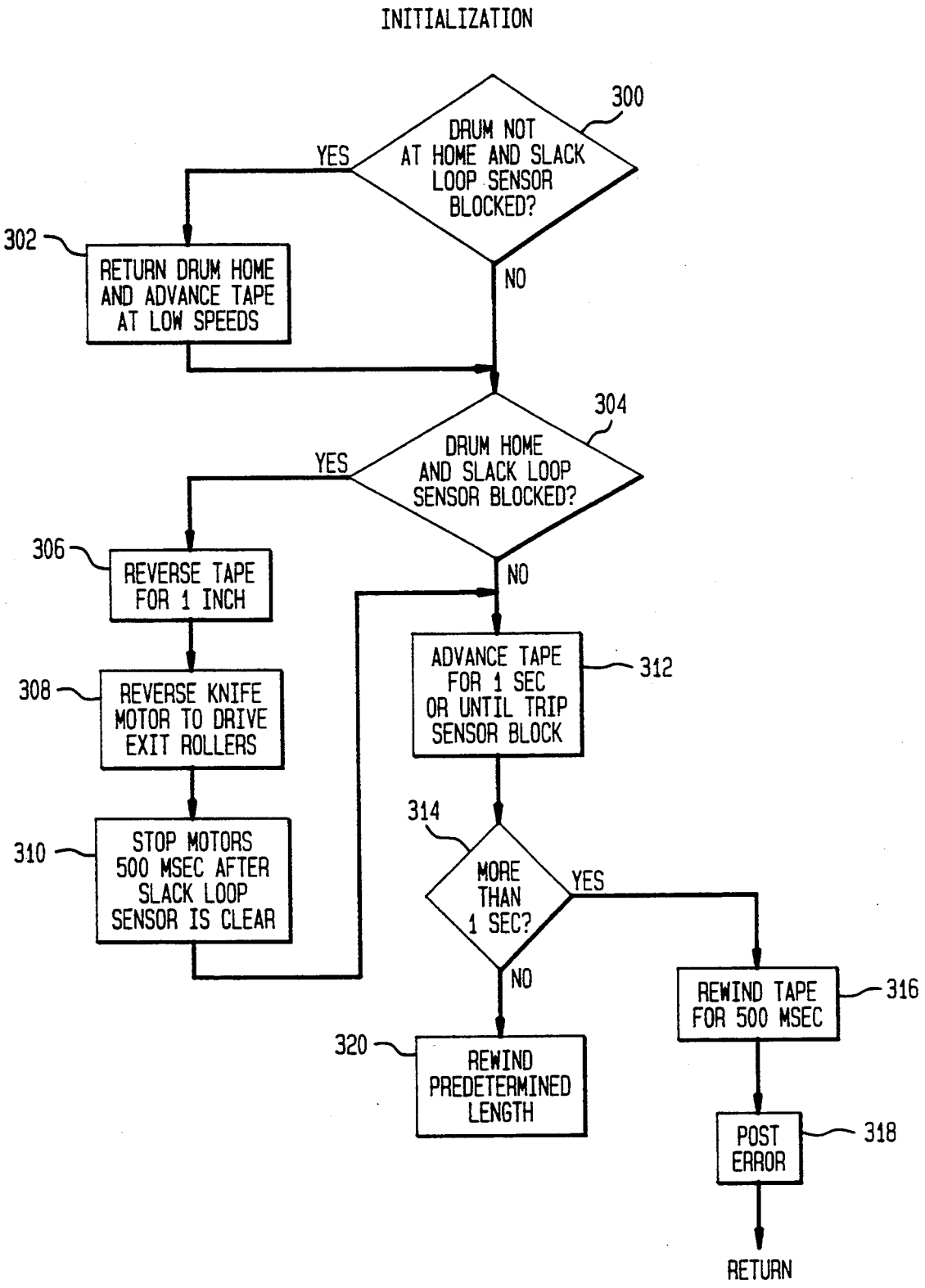
FIG. 6 is a flow chart of the initializing control of the tape-drive motor for clearing any failure conditions which might create a tape jam.

FIG. 6 is a flow chart of the initialization routine in accordance with the invention. For initialization, the position of the print drum and the condition of the slack loop sensor are tested, decision block 300. If the drum is not in the home position and the slack loop sensor is blocked, it is assumed that there was a power failure during the print cycle and it will be necessary to complete the printing operation. Accordingly, the drum and the tape are advanced at slow speed to complete the operation, block 302, and the routine returns to the initialization procedure. The NO path from decision block 300 falls to block 304 to test whether the slack loop sensor is blocked while the drum has returned home. If YES, it is assumed that the tape is in an undesired portion of the tape path for start up. Accordingly, the machine attempts to rewind an uncut portion of tape and to eject a cut piece of tape. The tape motor is driven to reverse the tape for approximately 1 inch, block 306, the knife motor is then reversed to drive the exit rollers, block 308, and both motors are stopped 500 msec after the slack loop sensor clears, block 310, after which the routine returns to the main initialization line.

The tape is then positioned to a known location, by advancing the tape until the trip sensor is blocked or until a maximum time of 1 sec has elapsed, block 312. If 1 sec elapses and the trip sensor has not been blocked, decision block 314, the tape is rewound for 500 msec, block 316, and an error signal posted, block 318. If the trip sensor has been blocked prior to the 1 second time out, the tape is rewound a predetermined amount, block 320. If at block 304 the answer is "NO", the program proceeds to block 312 and follows blocks 314, 320 or blocks 314,316, and 318 as the case may be.

It will thus be appreciated that the initialization procedure in accordance with the invention will serve to preclude any operation of the machine which would tend to continue advancing tape into the tape path where it could jam and thereby require a service call to clear the jam.

What is claimed is:

1. A method for initializing a mailing machine which includes a postage meter having a postage meter drum, a sensor for detecting a tape in a path and a knife for cutting the tape and means for ejecting a cut segment of tape, the method comprising the steps of: providing tests for determining if a plurality of conditions exist which are indicative of a failure to complete a proper sequence of ejection of a cut tape, providing a plurality of steps for ejecting the cut tape and for placing an end of a tape roll into a known initial position for recovering from the indicated failure to complete the proper sequence of ejection of the cut tape, testing to determine if the plurality of conditions indicative of the failure to complete the proper sequence of ejection of the cut tape from the mailing machine exist, and in response to detection of the indicated failure to complete the proper sequence of ejection of the cut tape selecting the plurality of steps in order to initialize the tape roll to the known initial position and to eject the cut tape whereby tape jams on succeeding operations are prevented.

2. The method of claim 1 where one of said plurality of conditions is that the postage meter drum is in a home position.

3. The method of claim 1 where one of said plurality of conditions is that the sensor is blocked to indicate that the tape is in a portion of the tape path where it should not be on start up of the mailing machine.

4. The method of claim 1 further comprising advancing the tape a predetermined amount to block another sensor for determining the location of an end of the tape.

5. A method for initializing a roll tape feeding cutting and ejecting apparatus in a mailing machine which includes a postage meter having a postage meter drum, a sensor in the apparatus for detecting the presence of a tape in a path and a knife for cutting the tape and means for ejecting a cut segment of tape, the method comprising the steps of: providing tests for determining if a plurality of conditions of said postage meter drum and said sensor exist which are indicative of a failure to complete a proper sequence of ejection of a cut tape, providing a plurality of steps for ejecting the cut tape and for placing an end of a tape roll into a known initial position for recovering from the indicated failure to complete the proper sequence of ejection of the cut tape, testing to determine if the plurality of conditions indicative of the failure to complete the proper sequence of ejection of the cut tape from the mailing machine exist, and in response to detection of the indicated failure to complete the proper sequence of ejection of the cut tape selecting the plurality of steps in order to initialize the tape roll to the known initial position and eject the cut tape whereby tape jams on succeeding operations are prevented.

6. A method for initializing a mailing machine having a postage meter drum, a slack loop sensor for detecting tape in a tape feed path, a knife for cutting the tape, a means for ejecting the cut tape and means for feeding the tape in the mailing machine, the method comprising the steps of:

a) determining if the postage drum is in a home position and if the slack loop sensor is blocked;

b) if both the slack loop sensor is blocked and the postage meter drum is not in the home position, driving the postage meter drum to the home position and feeding the tape toward the postage meter drum;

c) after step b) and also if the result of step a) is other than the postage meter drum not being in the home position and the slack loop sensor being blocked, determining if the postage meter drum is in the home position and if the slack loop sensor is blocked which is indicative of the cut piece of tape being in the mailing machine;

d) if as a result of step c) it is determined that the postage meter drum is in the home position and the slack loop sensor is blocked, ejecting the cut piece of tape; and e) if as a result of step c) it is determined that either the postage meter drum is not in the home position or the slack loop sensor is not blocked, initializing the tape roll to a known initial position.

* * * * *